US009271534B2

(12) United States Patent
Geary

(10) Patent No.: US 9,271,534 B2
(45) **Date of Patent: *Mar. 1, 2016**

(54) GARMENT WITH DRAWSTRING CLOSURE

(71) Applicant: Volcom, Inc., Costa Mesa, CA (US)

(72) Inventor: Daniel Geary, Costa Mesa, CA (US)

(73) Assignee: Volcom, LLC, Costa Mesa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/017,146

(22) Filed: Sep. 3, 2013

(65) Prior Publication Data

US 2014/0000010 A1 Jan. 2, 2014

Related U.S. Application Data

(63) Continuation of application No. 13/183,355, filed on Jul. 14, 2011, now Pat. No. 8,522,365.

(60) Provisional application No. 61/364,354, filed on Jul. 14, 2010.

(51) Int. Cl.

| | |
|---|---|
| ***A41F 1/00*** | (2006.01) |
| ***A41D 7/00*** | (2006.01) |
| ***A41F 9/02*** | (2006.01) |

(52) U.S. Cl.

CPC . *A41F 1/00* (2013.01); *A41F 9/025* (2013.01); *A41D 7/005* (2013.01); *A41D 2300/33* (2013.01)

(58) Field of Classification Search

CPC ..... A41D 2300/33; A41D 7/005; A41D 1/08; A41F 9/025; A41F 1/00

USPC ..... 2/235, 236, 237, 227, 228, 234, 2/219–221, 243.1, 336, 338, 403–405, 2/400, 402, 309, 323, 326, 76, 114, 109, 2/110, 105, 69, 78.1, 83, 463–466, 118, 2/121, 162; 24/712, 713.6, 713, 713.2, 24/713.4; 450/119, 121, 142, 77, 78, 136, 450/141

See application file for complete search history.

(56) References Cited

U.S. PATENT DOCUMENTS

| | | | |
|---|---|---|---|
| 181,155 | A | 8/1876 | Eager |
| 770,871 | A | 9/1904 | Slater |
| 788,275 | A | 4/1905 | Munter |
| 898,511 | A | 9/1908 | Schneider |
| 918,324 | A | 4/1909 | Holdgate |
| 1,043,003 | A | 10/1912 | Faegre |
| 1,407,705 | A | 2/1922 | Munter |
| 1,464,217 | A | 8/1923 | Petersen |

(Continued)

*Primary Examiner* — Amy Vanatta
(74) *Attorney, Agent, or Firm* — KPPB LLP

(57) ABSTRACT

Embodiments of the invention include a drawstring closure that allows two sides of a garment to securely and evenly tighten the garment and the fly of the garment. One embodiment of the invention includes a drawstring closure for use on a garment, including a first front panel, wherein the first front panel comprises a first tab, and wherein the first tab comprises a first opening through which a drawstring can be threaded; a second front panel, wherein the second front panel comprises a second tab, wherein the second tab comprises second and third openings through which a drawstring can be threaded; a first drawstring, wherein the first drawstring is attached to the first tab, the first drawstring is threaded through the third and the first opening; a second drawstring, wherein the second drawstring is attached to the first front panel; and the second drawstring is threaded through the second opening.

17 Claims, 6 Drawing Sheets

(56) References Cited

U.S. PATENT DOCUMENTS

| | | | | |
|---|---|---|---|---|
| 1,825,271 | A | 9/1931 | Karberg | |
| 1,937,356 | A | 11/1933 | Neustadt | |
| 2,259,236 | A | 10/1941 | Wellins et al. | |
| 2,409,381 | A | 10/1946 | Pease, Jr. | |
| 2,994,091 | A | 8/1961 | Aftergood, Jr | |
| 5,784,723 | A * | 7/1998 | Noble | A41C 1/003 2/228 |
| 6,199,215 | B1 * | 3/2001 | Biggerstaff | A41D 1/06 2/234 |
| 7,950,070 | B2 | 5/2011 | Beven | |
| 8,522,365 | B2 | 9/2013 | Geary | |
| 2005/0034220 | A1 | 2/2005 | Diamond et al. | |
| 2005/0273907 | A1 | 12/2005 | Fontes | |
| 2005/0283883 | A1 | 12/2005 | Fontes et al. | |
| 2007/0028363 | A1 | 2/2007 | Hansen | |
| 2012/0011638 | A1 | 1/2012 | Geary | |

* cited by examiner

Prior Art

Prior Art

GARMENT WITH DRAWSTRING CLOSURE

CROSS-REFERENCE TO RELATED APPLICATIONS

This application is a continuation of U.S. patent application Ser. No. 13/183,355, filed Jul. 14, 2011, which claims priority to U.S. Patent Application No. 61/364,354, filed Jul. 14, 2010, the disclosure of which is incorporated herein by reference.

FIELD OF THE INVENTION

The present invention relates generally to garments, and more specifically to board shorts having a drawstring closure.

BACKGROUND OF THE INVENTION

A variety of board short cuts and styles are available to provide a garment that is both flattering and functional during active use. In such a garment, it is desirable, both from a functional and aesthetic perspective, for the board shorts to lie flat and neatly in the fly area. A number of different fasteners and closures have been developed in an attempt to accomplish a flat, neat appearance when the fly is closed. Some examples of garment structures that have been used to keep flies closed in garments include fasteners, such as, zippers, snaps, buttons, and hook and loop fasteners (e.g., Velcro®), and closures, such as gussets. (See, e.g., U.S. Pat. Nos. 6,199,215 and 7,174,574.)

While these garment structures are used in most conventional garments with flies, including action sports swimwear such as board shorts, they have a number of drawbacks. First, all of these closure systems require attachment to the fly by way of a seam, which adds to the bulk of the garment and may cause the fly to bulge unaesthetically, especially where such fasteners extend the entire length of the fly. Second, in the case of fastener systems, the fastener can fail or be improperly fastened causing the garment to open unexpectedly. Third, in the case of a gusset, it is necessary for a fabric shield to interconnect the two sides of the fly, which adds to the bulk of the fly, can make it inconvenient to don the garment, and can be uncomfortable to the wearer. Finally, when such closure systems are used in swimsuits and board shorts designed for use while surfing, they have a tendency to be uncomfortable for a person laying on the surfboard.

Some garments attempt to address these issues by locating the closure, i.e., the buttons, snaps, clips, or ties only in the upper waistband of the fly. However, these garments do not address how to securely close the middle section of the fly. This presents a privacy problem, as the fly may open with the motion of the wearer.

SUMMARY OF THE INVENTION

Embodiments of the invention include board shorts having drawstring closures and improved drawstring eyelets.

In some embodiments, the drawstring closure system incorporates two separate laces attached to the waistband of a garment such that when they are tightened a horizontal oppositional force is applied in parallel to the two sides of the waistband to securely and evenly cinch the fly and waistband of the garment. In other embodiments, the laces are attached to the waistband at positions such that when the laces are fully cinched the attachment points of laces align with the eyelets, thereby providing controlled closure of the garment. In still other embodiments, the drawstring closure system incorporates eyelets having a gasket disposed within the eyelet opening, the gasket providing fixation of the lace within the eyelet.

One embodiment of the invention includes a drawstring closure for use on a garment, including a first front panel, wherein the first front panel includes a first tab, and wherein the first tab includes a first opening through which a drawstring can be threaded; a second front panel, wherein the second front panel includes a second tab, wherein the second tab includes second and third openings through which a drawstring can be threaded; a first drawstring, wherein the first drawstring is attached to the first tab, the first drawstring is threaded through the third and the first opening; a second drawstring, wherein the second drawstring is attached to the first front panel; and the second drawstring is threaded through the second opening.

In a further embodiment, at least one of the first opening, the second opening or the third opening is an eyelet.

In another embodiment, the second drawstring is configured to be pulled such that the second opening is aligned with the location of the second drawstring's attachment to the first front panel.

In an additional embodiment, at least one of the first opening, the second opening or the third opening is a gasketed eyelet, including an eyelet surrounding a deformable insert, wherein the deformable insert includes a slit opening; and the deformable insert is configured to allow a drawstring to pass through the slit opening.

In a further embodiment again, the first front panel and the second front panel share a waistband extending around the circumference of the garment and the waistband includes the first tab and the second tab.

In another embodiment again, the first front panel and the second front panel are constructed of a quick-dry fabric.

In an additional embodiment again, a facing strip extends coverage of the first front panel to overlap with the second front panel from a point at which the first front panel and the second front panel are connected.

In a yet further embodiment, the facing strip is configured to provide privacy to the wearer of the garment when the drawstring closure is fully tightened.

In a yet another embodiment, a facing strip extends coverage of the second front panel to overlap with the first front panel from a point at which the first front panel and the second front panel are connected.

In a yet additional embodiment, the facing strip is configured to provide privacy to the wearer of the garment when the drawstring closure is fully tightened.

In a further yet embodiment includes a method of constructing a drawstring closure for use on a garment with a first front panel and a second front panel, the method including attaching a first tab to the first front panel; opening a first opening in the first tab so that a drawstring can be threaded through the first opening; attaching a second tab on the second front panel; opening a second opening and a third opening in the second tab so that a drawstring can be threaded through each of the second and third openings; attaching a first drawstring to the first tab; threading the first drawstring through the third opening and the first opening; attaching a second drawstring to the first front panel; and threading the second drawstring through the second opening.

In another yet embodiment, at least one of the first opening, the second opening or the third opening is an eyelet.

In an additional yet embodiment, the second drawstring is configured to be pulled such that the second opening is aligned with the location of the second drawstring's attachment to the first front panel.

In a yet further embodiment again, the method includes creating at least one slit opening in a deformable insert configured to allow a drawstring to pass through the slit opening; and integrating the deformable insert into an opening of the garment.

A yet another embodiment again includes forming a waistband extending around the circumference of the garment as part of the first front panel and the second front panel, wherein the waistband includes the first tab and the second tab.

In a yet additional embodiment, the first front panel and the second front panel are constructed of a quick-dry fabric.

A yet again further embodiment includes connecting a facing strip extending coverage of the first front panel to overlap with the second front panel from a point at which the first front panel and the second front panel are connected.

In a yet again another embodiment, the facing strip is configured to provide privacy to the wearer of the garment when the drawstring closure is fully tightened.

A yet again additional embodiment includes connecting a facing strip extending coverage of the second front panel to overlap with the first front panel from a point at which the first front panel and the second front panel are connected.

In a yet again further embodiment again, the facing strip is configured to provide privacy to the wearer of the garment when the drawstring closure is fully tightened.

DETAILED DISCLOSURE OF THE INVENTION

The following detailed description describes the drawstring closure system of the present invention on a pair of board shorts. The drawstring closure system incorporates a novel drawstring system that allows for the application of a controlled horizontal oppositional force to the two sides of the waistband to securely and evenly tighten the fly and waistband of the garment. Although the embodiments described herein relate to the use of the drawstring closure system on a board short, it should be understood that the present invention may be used in other garment applications, including, but not limited to, pants, shorts, shirts, skirts, dresses for use in or out of water for both men and women. Regardless of the type of garment it is used on, the drawstring closure of the current invention allows for the elimination of all fly fasteners, thereby simplifying the construction of the fly and waist closure, creating a flatter thinner fly, as well as eliminating the chance of fastener failure during use.

Figure 1A:
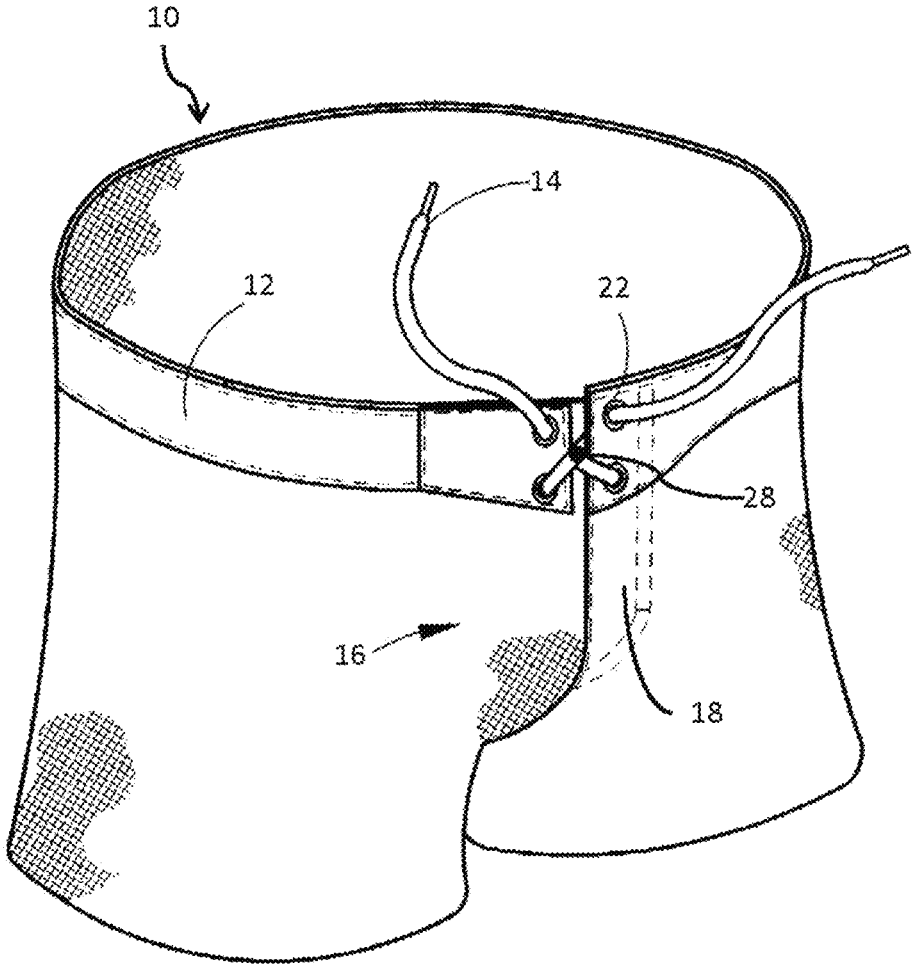
FIG. 1*a* is a front view of a conventional board short garment.

Turning now to the drawings, FIG. 1*a* provides a front view photograph of a pair of board shorts 10 having a conventional waistband and fly. As shown, the shorts include a waistband 12, that is secured via a drawstring 14 and a fly 16 that is secured along its length via a hook and loop fastener 18.

Figure 1B:
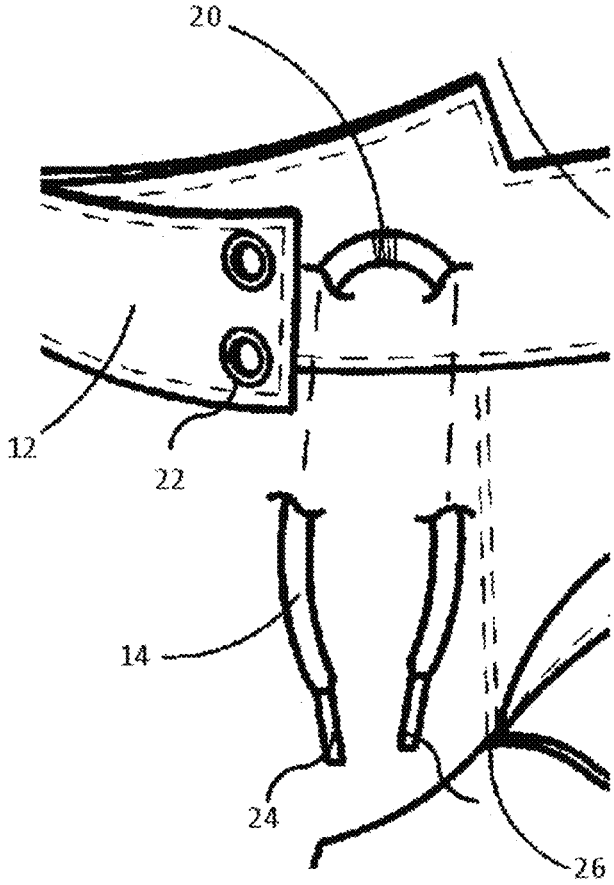
FIG. 1*b* is a close-up front view of the fly of the board short garment shown in FIG. 1*a*.

FIG. 1*b* shows a detailed view of the construction of the drawstring waistband. As shown, the drawstring 14 comprises a single unitary length of lace that is affixed onto the waistband 12 at a single point 20, referred to as a bartack. This bartack 20 serves to fix the single unitary drawstring 14 into place so it does not become detached from the waistband 12. When the waistband is to be secured, the drawstring 14 is threaded through the eyelets 22 such that the two ends of the drawstring 24 and 26 are being pulled in opposite directions. It should be understood that although the waistband shown in FIGS. 1*a* and 1*b* has four eyelets, waistbands of this type have been and can be formed with any number of eyelets such that the two ends of the drawstring are disposed in opposite directions and can be tightened to cinch the waist securely closed.

A problem with the conventional drawstring closure shown in FIGS. 1*a* and 1*b* is that when the waistband is tightened via the drawstring, the vector of the forces does not pull the two sides of the waistband toward each other horizontally, but instead tends to draw them diagonally into a center point 28 where the ends of the drawstring 24 and 26 cross over each other. This results in an unaesthetic and uncomfortable bunching of the waistband at the center point. In addition, it also has a tendency to misalign the underlying fastener 18, in this case a hook and loop type fastener, resulting in further bunching or bulging along the fly 16. This design means that to obtain a good fit, the wearer must often readjust the fly and waistband after tightening and securing the drawstring. The current invention improves the wearability of a garment such as a board short, as the inventive drawstring closure will serve to securely lock the waistband and fly of the garment into position even where there is a fastener failure.

Figure 2:
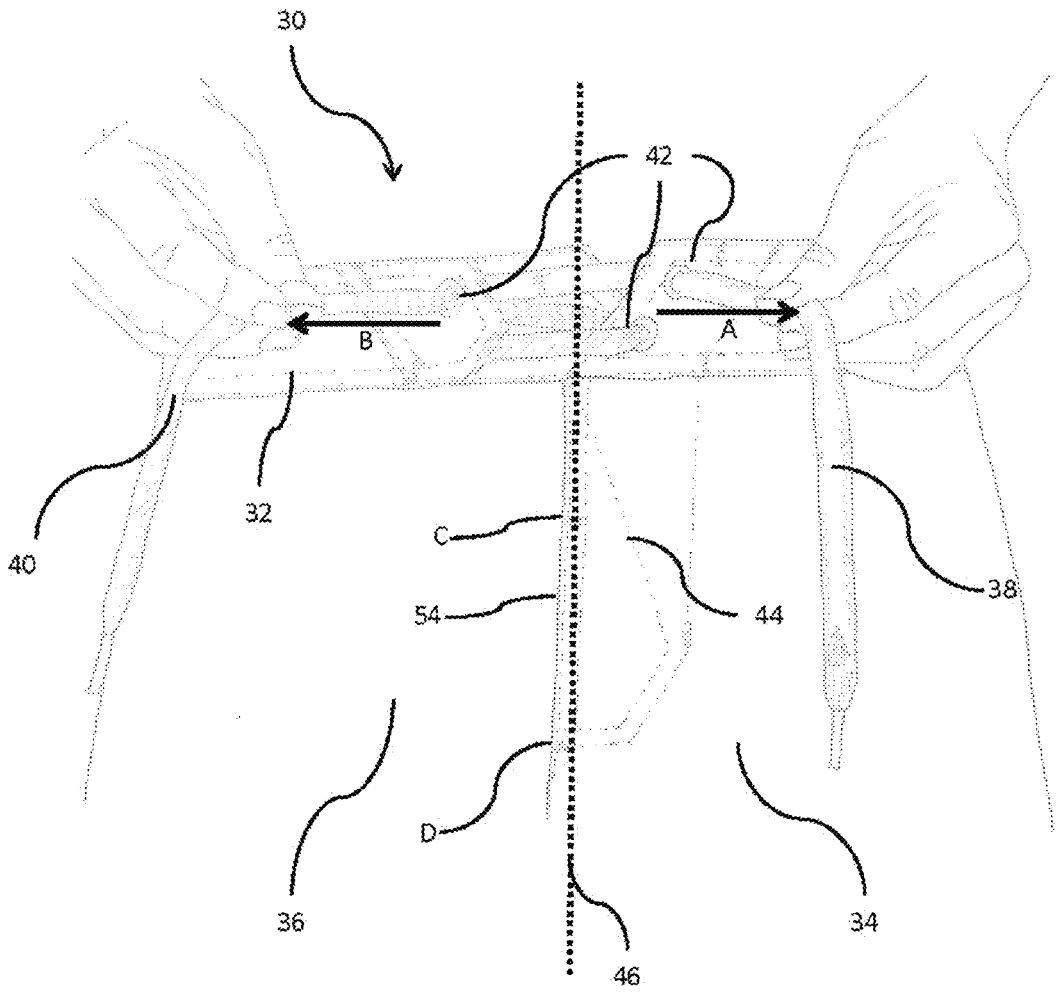
FIG. 2 is a front view of a multi-drawstring board short in accordance with an embodiment of the invention.

Turning now to the drawstring closure of the current invention, an embodiment of which is shown in FIGS. 2 and 3. FIG. 2 provides a front view of an embodiment of the board shorts. As shown, the garment 30 includes a waistband 32, a right front panel 34, and a left front panel 36. Two independent laces 38 and 40 extend through eyelets 42 at the waistband 32 close to the fly 44 and in opposite directions from the fly. The presence of two separate drawstrings allows for the even application of horizontally aligned oppositional tightening forces to the right and left panels (34 & 36) as shown by arrows "A" and "B", thereby allowing for the panels to be drawn toward a center line 46 that extends along the fly. As in the above discussion, the garment incorporating this drawstring closure is preferably constructed of a quick-dry type fabric, such as, for example, nylon, polyester, etc.

Figure 3A:
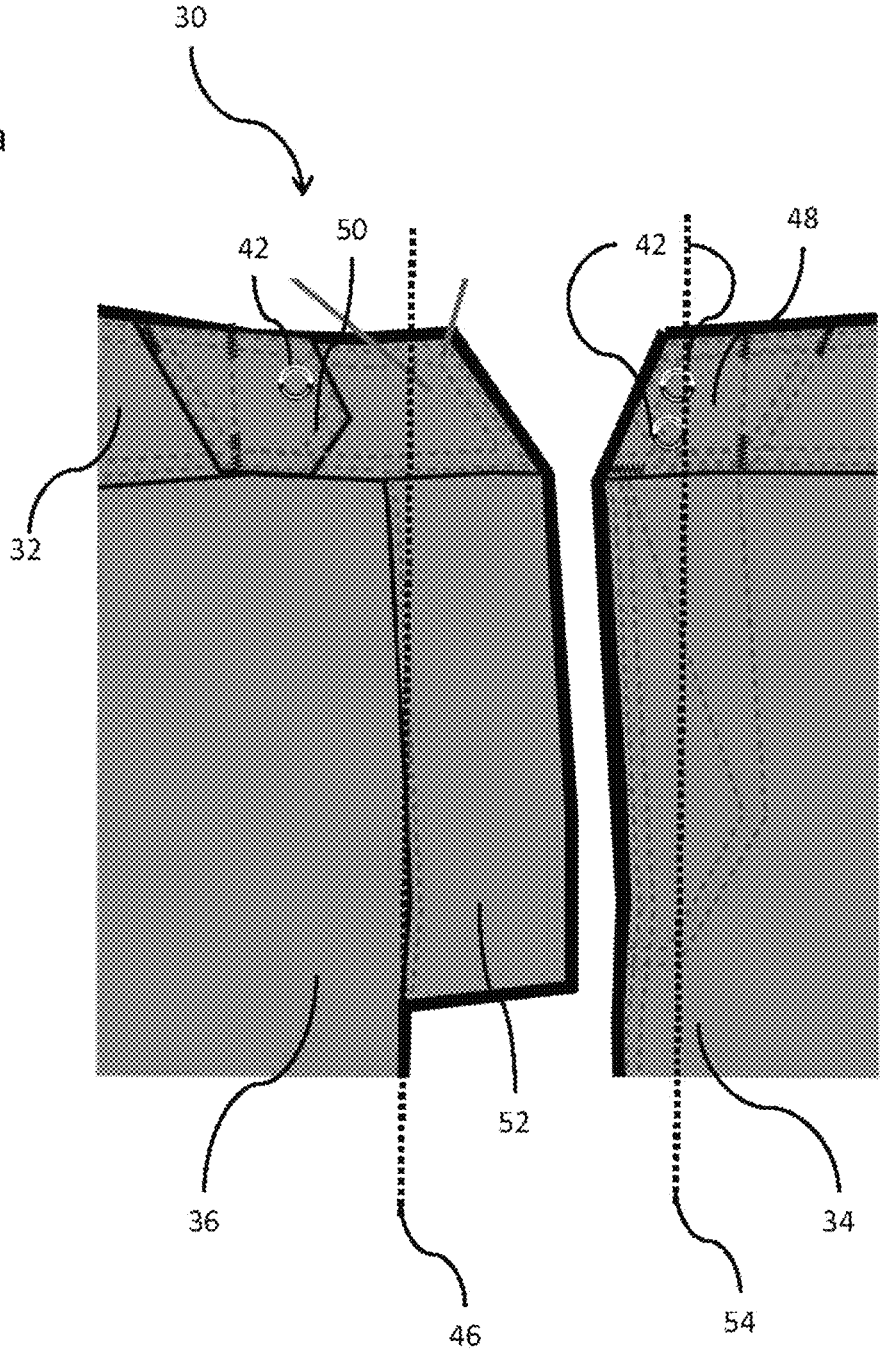
FIG. 3*a* is an exploded view of the front of the board short illustrated in FIG. 2 showing a fly configuration in accordance with an embodiment of the invention.
Figure 3B:
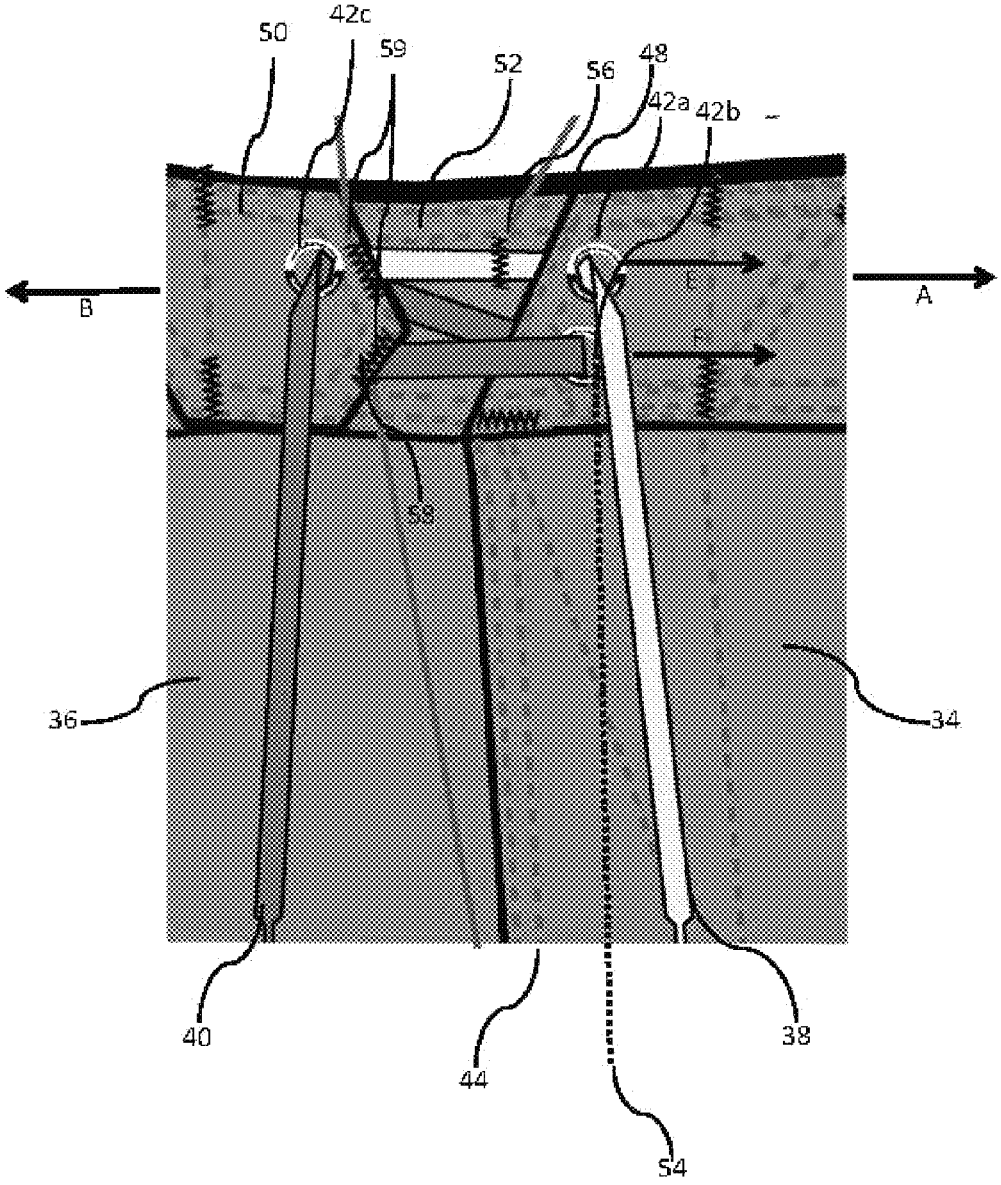
FIG. 3*b* is a close-up front view of the front of the board short shown in FIG. 3*a* with the drawstrings attached.

The detailed construction of the fly and drawstring waistband is provided in FIGS. 3*a* and 3*b*. In FIG. 3*a* the shorts 30 have been partially cut away, disassembled, and pulled apart in the fly area. As shown, the shorts 30 generally consist of right 34 and left 36 panels. The top of each panel is defined by the waistband 32, which extends around the circumference of the shorts. Eyelets 42 are disposed at the level of the waistband on the right and left panels such that drawstring laces (not shown) may be threaded therethrough.

Although the eyelets may be disposed in any number and any suitable manner such that the laces of the drawstring closure may be threaded therethrough to provide an oppositional tightening force to the waistband, in the embodiment, shown in FIGS. 3*a* and 3*b*, three eyelets 42 are disposed on right and left sides of the waistband 32. In the embodiment shown in FIGS. 2 and 3, the eyelets on the right hand side of the waistband are attached directly to the waistband at region 48, whereas the eyelet on the left side is attached to a separate eyelet tab 50, which is in turn attached to the waistband 32. It should be understood that both sets of eyelets could be attached either directly to the waistband or to separate tabs in any combination without impacting the operation of the drawstring closure of the invention.

Turning to the construction of the fly 44, as shown in FIG. 3*a*, in one embodiment the fly generally comprises a facing strip or insert 52 that extends along centerline 46 from the waistband to an attachment point at which the two panels 34 and 36 are sewn together. The facing strip or insert 52 may be of any width sufficient to provide privacy to the wearer when the drawstring closure is fully tightened. In one embodiment, the fly 44 is constructed such that when the drawstring waistband is tightened the facing strip 52 extends beyond a vertical line 54 defined by the position of the eyelets 42 disposed on the opposing panel of the shorts. For example, in the embodiment shown in FIG. 3*a*, the facing strip 52 disposed on the left panel 36 would extend at least beyond eyelets disposed on the right panel 34.

The length of the fly 44 between the waistband 32 and to the attachment point at which the two panels 34 and 36 are sewn together along the central seam can also be varied depending on the type of garment to be made. In general, the fly only needs to be long enough to ensure that the waist of the garment can be opened sufficiently to ensure the wearer can don the garment comfortably. Moreover, a shorter fly is generally preferable as it allows for greater security and privacy. Accordingly, in one embodiment, shown in FIG. 2, the working length of the fly 44 may be shortened. To shorten the working length of the fly 44, a shortened or secondary attachment point "C" is employed along the center seam 54 and above the standard attachment point "D". The fly is sewn closed at this secondary attachment point and will not open along the seam 54 below this attachment point. Although, in this embodiment the fly below the secondary attachment point is effectively non-functional, as shown in FIG. 2, for aesthetic reasons stitching may be continued along the garment such that the fly appears to extend the full length of the front portion of the garment.

Turning to the disposition of the laces in the drawstring closure, as shown in FIG. 3*b*, the current invention employs two independent laces 38 and 40. These laces may be disposed in any fashion suitable to ensure that an even horizontal oppositional force is applied to the two panels of the waistband when the laces are tightened. In one embodiment, shown in FIG. 3*b*, top 38 and bottom 40 laces are attached to one panel or side of the garment. These laces are then drawn through the eyelets 42 such that the laces are disposed in opposite directions "A" and "B" along the waistband. In particular, in one embodiment the top lace 38 is at least attached or bartacked to the upper edge of the waistband 32 on the facing strip 52 of the fly 44. The top lace is then threaded through the top eyelet 42*a* on the opposite panel of the garment. When the top lace 38 is pulled thru the opposing upper eyelet 42*a*, it cinches tight until the point 56, at which the lace is bartacked to the facing strip, reaches the eyelet. Accordingly, the point 56 at which the lace is bartacked to the facing strip 52 determines the extent to which the waistband may be tightened, thus fixedly aligning the bartack behind the eyelet and locking the drawstring and waistband in proper position.

As shown in FIGS. 2 and 3*b*, the lace 38 may also be attached or bartacked to the eyelet tab 50 to ensure that the tab lies flat along the waistband for aesthetic reasons. It is to be understood that the specific position of the attachment point(s) 56 of the top lace 38 will depend on how far the two sides of the waistband are to be cinched. Any position may be used such that the waistband is cinched closed sufficiently to ensure that the garment is held securely on the wearer, and that the fly provides sufficient privacy. With regard to the issue of privacy, in one preferred embodiment, the lace is attached at a point such that when the drawstring waistband is tightened the facing strip 52 extends beyond a vertical line 54 defined by the position of the eyelets 42 disposed on the opposing panel of the shorts thereby ensuring privacy to the wearer even during active motion.

The lower lace 40 is attached or bartacked separately at the lower edge of the waistband 32 and extends across the fly 44 to the opposing panel lower eyelet 42*b* and thru. From there the lace 40 is redirected back up to the original panel and thru the upper eyelet 42*c*. Although the lower lace is shown being attached at a point 58 on the eyelet tab 50, it should be understood that it may also be attached or bartacked to the facing strip 52 of the fly 44 as shown for the top lace. In such an embodiment, the lace may also be attached or bartacked 59 to the eyelet tab 50 to ensure that the tab lies flat along the waistband for aesthetic reasons.

During tightening, once the laces are threaded thru the appropriate eyelets, both drawstrings are pulled in opposite directions "A" and "B" along the waistband. The arrangement of the laces 38 and 40 generates a pair of parallel force vectors, shown by the arrows "E" and "F", that pull the two sides of the waistband horizontally toward each other in a controlled fashion. In turn, the position of the attachment points 56 and 58 of the laces 38 and 40 provide stop points, such that the cinching action of the drawstring closure is stopped once the bartacks reach the eyelets, ensuring proper alignment of the two panels of the waistband. Accordingly, tightening the waistband using the drawstring closure of the instant invention ensures that the waistband has been cinched and locked into position, and is ready to be tied.

As shown in the embodiments disclosed herein, preferably the fly is an open fly and has no fastener or gusset of any sort. It should be understood that an open fly is not essential to the operation of the improved drawstring closure of the current invention, and that a fastener system, such as zippers, buttons, snaps, or hook and loop devices may be incorporated into the fly. Likewise, although not necessary to the function of the garment, a gusset, such as those disclosed by U.S. Pat. Nos. 6,199,215 and 7,174,574, the disclosure of which are incorporated herein by reference, may similarly be incorporated into the drawstring closure of the invention.

Figure 4:
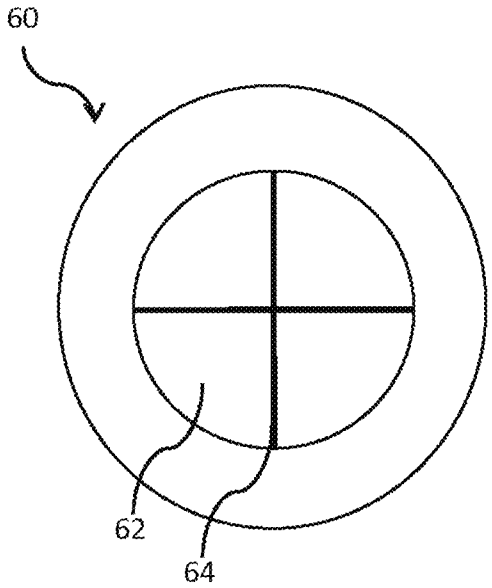
FIG. 4 is a front view of a gasket-containing eyelet, in accordance with an embodiment of the invention.

Finally, although conventional eyelets have been described thus far, in one embodiment, as shown in FIG. 4, the eyelet 60 may be provided with a deformable insert 62, such as a plastic or rubber gasket, with a slit opening 64 for the lace to extend through. During use, this gasket applies a frictional force to the lace to help to hold the lace in place such that it does not slip uncontrollably back through the eyelet while being tightened and tied off.

While the above description contains many specific embodiments of the invention, these should not be construed as limitations on the scope of the invention, but rather as an example of one embodiment thereof. In particular, as previously discussed, the drawstring closure system of the present invention may be used in applications other than board shorts. Accordingly, the scope of the invention should be determined not by the embodiments illustrated, but by the appended claims and their equivalents.

What is claimed is:

1. A pair of board shorts having a drawstring closure, comprising:

a first front panel, wherein:

the first front panel comprises a first tab, and wherein:

the first tab comprises a first opening through which a drawstring can be threaded;

a second front panel, wherein:

the second front panel comprises a second tab, wherein:

the second tab comprises second and third openings through which a drawstring can be threaded;

a first drawstring, wherein:

the first drawstring is attached to the first tab, the first drawstring is threaded through the third and the first opening;

a second drawstring, wherein:

the second drawstring is attached to the first front panel; and the second drawstring is threaded through the second opening.

2. The pair of board shorts of claim 1, wherein at least one of the first opening, the second opening or the third opening is an eyelet.

3. The pair of board shorts of claim 1, wherein the second drawstring is configured to be pulled such that the second opening is aligned with the location of the second drawstring's attachment to the first front panel.

4. The pair of board shorts of claim 1, wherein at least one of the first opening, the second opening or the third opening is a gasketed eyelet, comprising:

an eyelet surrounding a deformable insert, wherein:

the deformable insert comprises a slit opening; and the deformable insert is configured to allow a drawstring to pass through the slit opening.

5. The pair of board shorts of claim 1, wherein the first front panel and the second front panel share a waistband extending around the circumference of the board shorts and the waistband comprises the first tab and the second tab.

6. The pair of board shorts of claim 1, wherein the first front panel and the second front panel are constructed of a quick-dry fabric.

7. The pair of board shorts of claim 1, wherein a facing strip extends coverage of the first front panel to overlap with the second front panel from a point at which the first front panel and the second front panel are connected.

8. The pair of board shorts of claim 7, wherein the facing strip is configured to provide privacy to the wearer of the board shorts when the drawstring closure is fully tightened.

9. The pair of board shorts of claim 1, wherein a facing strip extends coverage of the second front panel to overlap with the first front panel from a point at which the first front panel and the second front panel are connected.

10. The pair of board shorts of claim 9, wherein the facing strip is configured to provide privacy to the wearer of the board shorts when the drawstring closure is fully tightened.

11. A pair of board shorts having a drawstring closure, comprising:

a first front panel, wherein:

the first front panel comprises a first tab, and wherein:

the first tab comprises a first opening through which a drawstring can be threaded;

a second front panel, wherein:

the second front panel comprises a second tab, wherein:

the second tab comprises second and third openings through which a drawstring can be threaded;

a first drawstring, wherein:

the first drawstring is attached to the first tab, the first drawstring is threaded through the third and the first opening;

a second drawstring, wherein:

the second drawstring is attached to the first front panel; and the second drawstring is threaded through the second opening;

wherein the first front panel and the second front panel share a waistband extending around the circumference of the board shorts and the waistband comprises the first tab and the second tab; and wherein the second drawstring is attached to the first tab to configure the first tab to lie flat along the waistband.

12. A pair of board shorts having a drawstring closure, comprising:

a first front panel, wherein:

the first front panel comprises a first tab, and wherein:

the first tab comprises a first opening through which a drawstring can be threaded;

a second front panel, wherein:

the second front panel comprises a second tab, wherein:

the second tab comprises second and third openings through which a drawstring can be threaded;

a first drawstring, wherein:

the first drawstring is attached to the first tab, the first drawstring is threaded through the third and the first opening;

a second drawstring, wherein:

the second drawstring is attached to the first front panel; and the second drawstring is threaded through the second opening;

wherein the first front panel and the second front panel share a waistband extending around the circumference of the board shorts and the waistband comprises the first tab and the second tab; and wherein the second drawstring is further attached on the upper edge of the waistband on a facing strip.

13. The pair of board shorts of claim 12, wherein the second drawstring is pulled through the second opening until the attachment point of the second drawstring to the upper edge of the waistband reaches the second opening.

14. The pair of board shorts of claim 13, wherein the second drawstring is further attached to the upper edge of the waistband on the facing strip such that when the drawstring waistband is tightened, the facing strip extends beyond a vertical line defined by the position of the second and third openings to ensure privacy to the wearer.

15. The pair of board shorts of claim 13, wherein the first drawstring is configured to be threaded through the third opening and redirected back towards the first tab to be threaded through the first opening.

16. The pair of board shorts of claim 15, wherein the first drawstring is pulled in an opposite direction of the direction that the second drawstring is pulled until the attachment point of the first drawstring to the first tab reaches the third opening.

17. A pair of board shorts having a drawstring closure, comprising:

a first front panel, wherein:

the first front panel comprises a first tab, and wherein:

the first tab comprises a first opening through which a drawstring can be threaded;

a second front panel, wherein:

the second front panel comprises a second tab, wherein:

the second tab comprises second and third openings through which a drawstring can be threaded;

a first drawstring, wherein:

the first drawstring is attached to the first tab, the first drawstring is threaded through the third and the first opening;

a second drawstring, wherein:

the second drawstring is attached to the first front panel; and the second drawstring is threaded through the second opening;

wherein the first front panel and the second front panel share a waistband extending around the circumference of the board shorts and the waistband comprises the first tab and the second tab; and wherein the first tab is attached to the waistband to configure the first tab to lie flat along the waistband.

* * * * *